United States Patent [19]

Sudo et al.

[11] 4,331,488

[45] May 25, 1982

[54] COLD-ROLLED ULTRA LOW CARBON STEEL SHEET WITH IMPROVED PRESS-FORMING PROPERTIES

[75] Inventors: Masatoshi Sudo; Ichiro Tsukatani, both of Kobe, Japan

[73] Assignee: Kobe Steel, Ltd., Kobe, Japan

[21] Appl. No.: 198,840

[22] Filed: Oct. 20, 1980

[30] Foreign Application Priority Data

Oct. 18, 1979 [JP] Japan ..... 54-134809

[51] Int. Cl.[3] ..... C22C 38/28

[52] U.S. Cl. ..... 148/36; 75/126 D

[58] Field of Search ..... 148/36, 12 C, 2, 12.3, 148/12 F, 12 D; 75/124, 126 D, 125 P

[56] References Cited

U.S. PATENT DOCUMENTS 3,857,740 12/1974 Gondo et al. ..... 148/12.3 X
4,016,740 4/1977 Gondo et al. ..... 148/12 CX

FOREIGN PATENT DOCUMENTS 50-10688 4/1975 Japan ..... 75/126 D
50-25891 8/1975 Japan ..... 148/12 F

*Primary Examiner*—Peter K. Skiff
*Attorney, Agent, or Firm*—Oblon, Fisher, Spivak, McClelland & Maier

[57] ABSTRACT

The present invention discloses a cold-rolled ultra low carbon steel sheet with improved press-forming properties, which comprises 0.002–0.015% of C, less than 0.006% of N, less than 0.01% of O, less than 0.02% of S, 0.1–0.35% of Mn, 0.01–0.06% of acid-soluble Al, 0.02–0.15% of Ti, and 0.05–0.4% of Cr, and has a value less than 0.8 for the atomic ratio (Ti*/(C+N)) of the total titanium content except titanium of oxide form (Ti*) to the sum of carbon and nitrogen contents, with the balance Fe and incidental impurities. This steel has sufficient values of yield and tensile strengths; is excellent in various properties such as elongation, work hardening index, $\bar{r}$ value, aging index and Erichsen value; and shows good press-forming properties without any special overaging treatment.

2 Claims, 3 Drawing Figures

COLD-ROLLED ULTRA LOW CARBON STEEL SHEET WITH IMPROVED PRESS-FORMING PROPERTIES

BACKGROUND OF THE INVENTION

1. Field of the Invention

The present invention relates to a cold-rolled ultra low carbon steel sheet having excellent press-forming properties.

2. Description of the Prior Art

The improvement in the press-forming properties of a steel sheet depends upon the annealing process subsequent to the rolling operation. In this connection, many studies have thus far been made that advance various proposals with regard to the combination of the steel composition and the annealing process. Steel compositions that can be imparted with a high press-forming property during annealing within a short time period by resorting to quick heating and quick cooling cycles, as in continuous annealing, are advantageous from the standpoint of productivity. Examples of such steel include Ti-added ultra low carbon steel and ultra low carbon alumi-killed steel.

Ti-added ultra low carbon steel has been regarded as the sole material which withstands severe press-forming operations. However, production of this steel requires the addition of Ti in a large quantity and the use of high vacuum-degassing techniques, such as the DH method, in view of the amount of added Ti. In addition, annealing at a higher temperature over a longer time period than that required for ordinary rimmed steel is required, thereby increasing the cost of manufacture.

On the other hand, ultra low carbon alumi-killed steel has been proposed as a steel material which is cheaper than the Ti-added steel but which still has relatively good press-forming properties (Japanese Patent Publication Nos. 53-22052 and 53-39850). However, it suffers from an inherent drawback in that the steel sheet must be wound up in a high temperature region in order to accelerate the precipitation of AlN, even though this leads to the production of an increased amount of scale. This scale imposes a greater burden in the subsequent acid-washing stage and causes deterioration of the surface of the steel plate. The quality of the opposite end portions of the coils which are taken up at lower temperatures is also poor. In addition, ultra low carbon alumi-killed steel requires annealing at higher temperatures than rimmed steel and, notwithstanding its small carbon content of about 0.01%, needs complete overaging treatment as with ordinary steel to eliminate degradation of press-forming properties by aging.

In order to provide overaging, which is required for enhancing the forming properties as mentioned above, annealing has to be provided with a heat cycle that is particularly designed for this purpose. Line I in the graph of FIG. 1 shows a typical heat cycle in a conventional annealing process in which, subsequent to heating at a high temperature level (a), a predetermined temperature (b) is maintained for a long time period to ensure sufficient overaging. Curve II is a heat cycle of a recently developed complete overaging process, involving a complicated operation of repeat heating and cooling that is disadvantageous in view of the burden on equipment and the increase in operational steps.

SUMMARY OF THE INVENTION

In an attempt to eliminate the above-mentioned problems both in steel properties and in the conventional manufacturing processes, the present inventors conducted extensive research on the influence of alloying components on the press-forming properties of ultra low carbon aluminum-killed steel. As a result it was found that a small amount of Ti additive in a particular ratio to the amounts of C and N present and coexistent with Cr produces improved press-forming properties to a maximum degree while lessening the adverse effects of the solid solution of carbon in steel on press forming properties. Thus, good press-forming properties without a special overaging treatment are obtained in a steel sheet.

More particularly, the present invention provides a cold-rolled ultra low carbon steel sheet that contains about 0.002–0.015% of C, less than about 0.006% of N, less than about 0.01% of O, less than about 0.02% of S, about 0.10–0.35% of Mn, about 0.01–0.06% of acid-soluble Al (sol. Al), about 0.02–0.15% of Ti, and about 0.05–0.04% of Cr, and which has a value of less than about 0.8 for the atomic ratio (Ti*/(C+N)) of the total Ti content except titanium in an oxide form (hereinafter referred to as "Ti*" for brevity) to the sum of carbon and nitrogen contents (C+N), with the balance Fe and incidental impurities. The steel sheet can further contain, in addition to the above-mentioned components, either about 0.001–0.1% of a rare earth element (REM) or about 0.001–0.01% of B, or it may contain both a REM and B in these amounts.

Japanese Laid-open Patent specification No. 53-137021 discloses a contemplated improvement in the press-forming property of ultra low carbon steel by the addition of a small amount of Ti similar in amount to the present invention. However, in the disclosed method of the patent, which defines the conditions of continuous casting and continuous annealing processes, the titanium compound (TiC) is retained in melt form as long as possible until a hot-rolled plate is obtained in the stage of hot rolling. This allows recrystallization of TiC to proceed preferentially to precipitation in the subsequent continuous annealing stage, thereby preventing strong suppression of recrystallization of TiC and precipitating TiC in as high a temperature range as possible. Larger grains are produced, resulting in a steel sheet which shows good press-forming properties while allowing a low temperature annealing treatment during a short time period. However, even this method fails to ensure sufficient press-forming properties because of the adverse effects of carbon which remains in the steel without being fixed in the form of TiC and which causes an increase in the yield stress and a reduction in elongation.

On the contrary, the present invention, by defining the additive amount of Ti in a particular atomic ratio (Ti/(C+N)) and producing synergistic effects by the joint addition of Cr, can effectively prevent the above-mentioned problems without imposing any restrictions on the continuous casting and hot-rolling processes. It is still possible to maintain continuous low temperature annealing during a short time period involving only quick heating and cooling. In addition, it becomes unnecessary to effect complete overaging as shown by lines I and II of FIG. 1. A cycle is employed in which a predetermined temperature (b) is maintained for a short time period after annealing to effect incomplete overaging as indicated by line III, or the temperature is quickly lowered to room temperature after annealing, completely omitting the overaging treatment as indicated by dotted line IV.

BRIEF DESCRIPTION OF THE DRAWINGS

Various other objects, features and attendant advantages of the present invention will be more fully appreciated as the same become better understood from the following detailed description when considered in connection with the accompanying drawings, wherein.

DETAILED DESCRIPTION OF THE PREFERRED EMBODIMENTS

The respective components of the steel according to the invention are limited to the above-defined ranges for the following reasons.

An increase in the C-content supresses growth of orstenite grains and increases the amount of TiC precipitation. The upper limit of the C-content should be about 0.015% in order to allow impartment of forming properties during a continuous low temperature annealing of a short time period. However, an extremely low C-content makes the melting operation difficult in a steel melting furnace on an ordinary commercial scale and gives rise to an increase in the oxygen content of the steel, which causes deterioration of the forming properties. Thus, the lower limit of the C-content should be placed at about 0.002%.

The N-content should be as small as possible since nitrogen lowers extendability and thus causes deterioration in the flanging property of steel in press machining or other operations. The upper limit of the N-content should preferably be placed at about 0.002%.

Smaller S- and O-contents result in a higher yield of unoxidized Ti and improved forming properties. Therefore, the S- and O-contents should be as small as possible, preferably less than about 0.02% and 0.01%, respectively.

The Mn-content has the effect of preventing hot brittleness due to S-content, and thus the steel should contain more than about 0.01% Mn. However, an excessive Mn-content generally causes deterioration of forming properties. In a steel of low carbon content, as in the present invention, the adverse effect of excess Mn on forming properties is very slight, but Mn undesirably raises the recrystallizing temperature. Therefore, the upper limit of the Mn-content is preferred to be about 0.35%.

The Al-component acts as an oxidizer in the melting stage and is effective for fixing N into a harmless form of AlN. Therefore, the Al-component should be present in more than about 0.01%. However, with an excessive addition of aluminum, the abovementioned effects become saturated and there occurs a degradation in surface conditions caused by an increase of non-metallic inclusions or a reduction in the grain size of recrystallization. Thus, the upper limit of the Al-content should be about 0.06%.

Increases in the Ti-content enhance the deep drawing property, which is improved by fixing the C- and N-components of the steel into the form of carbonitride (Ti(C,N)), as is well known in the art. However, increases in the amount of Ti present are reflected by large increases in production cost. For this reason, the lower limit of the Ti additive is about 0.02% and the upper limit is about 0.15% in the present invention. The amount of additive Ti is further limited to a value of less than about 0.8 for an atomic ratio (Ti*/(C+N)) of the total titanium content except titanium in oxide form (Ti*) to the sum of C- and N-contents. Thereby the amount of added Ti is optimized while still sufficiently enhancing the deep drawing property.

Figure 2:
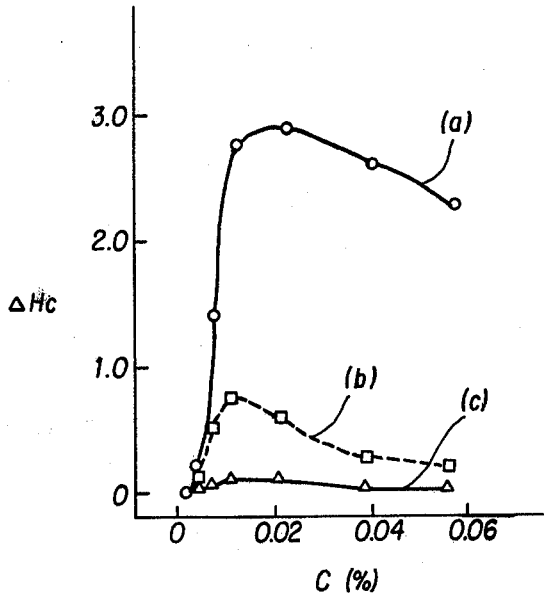
FIG. 2 is a graph showing increase in anti-magnetic force (ΔHc) after aging of Ti-Cr added steel.

Deviations from the above-defined ranges of the respective components will give rise to the problem of aging in a case where overaging treatment is omitted, even if the C-content is less than the above-defined upper limit of about 0.015%. FIG. 2 shows the relation between the increase (ΔHc) in anti-magnetic force (Hc) and the C-content in steel samples containing no Ti, about 0.2% of Cr, about 0.006% of N, about 0.008% of O, about 0.01% of S, and about 0.20 to 0.25% of Mn. These samples have a value of 0 for the atomic ratio Ti*/(C+N). The samples were subjected to annealing by retaining the temperature at 710° C. for 3 minutes; (a) water cooling, (b) air-cooling or (c) air-cooling followed by a heating treatment 450° C.×100 hours air-cooling; and an aging treatment of 150° C. ×100 hours. It is observed from these data that, when an overaging treatment is omitted, a sample with a C-content less than about 0.015% is more susceptible to aging than a sample with a C-content greater than about 0.015%.

If Ti is added to these material, the C- and N-components in the steel are fixed sufficiently to suppress the aging, and the flanging property is improved. Since Ti has a strong N-fixing effect, there is no need for wind-up at high temperature or for other special operations as required in a case where only Al is added.

Figure 3:
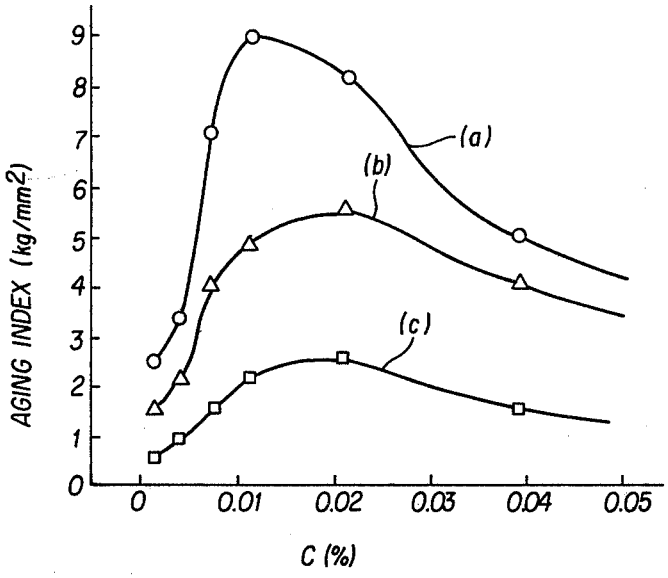
FIG. 3 is a graph showing the aging index of the various steels.

The addition of Cr jointly with Ti improves the deep drawing property even more than does the addition of Ti alone. This effect accrues from the fact that TiC precipitates easily in greater grain sizes under the coexistence of Cr. The Cr-component, in addition to improving the deep drawing property, serves to suppress the possibility of aging due to the solution of C which is not bonded in the form of Ti(C,N). FIG. 3 shows the relation between the aging index (kg/mm$^2$) and the C-content in sample (a), ordinary alumi-killed steel; sample (b), Ti-added alumi-killed steel (with Ti*/(C+N) of below 0.8); and sample (c), alumi-killed steel with jointly added Ti and Cr (containing about 0.03–0.11% of Ti, about 0.2% of Cr, about 0.003% of N, about 0.008% of O, about 0.007% of S and about 0.20% of Mn, and having Ti*/(C+N) of about 0.5). Each sample steel was subjected to annealing at 750° C.×0.5 minute, cooling down to room temperature at a cooling speed of about 10° C./sec, application of 5% distortion, and aging treatment of 100° C.×0.5 hour. It is clear therefrom that the aging index is lowered considerably by the addition of Ti, but all the more stabilized at a low level by the joint addition of suitable amounts of Ti and Cr.

In order to produce the above-mentioned effect of Cr in a sufficient degree, the Cr-content should be more than about 0.05%. However, the steel of the present invention has a relatively small Ti-content, and there is no necessity for adding Cr in excess of about 0.4%.

In addition to the above-described components, the steel of the present invention may contain a rare earth metal (REM) and boron. REM serves to lessen the amount of impurity S and to control the shape of, and convert into harmless forms, the sulfide inclusions that impose adverse effects on the forming workability. For these purposes, REM may comprise more than about 0.001% of the steel but need not be added in excess of about 0.1%. On the other hand, the B-component has the effect of fixing N in a harmless form and therefor is added in an amount of more than about 0.001% but less than about 0.01%. These REM- and B-components are added in the above-defined ranges solely or jointly, thereby to enhance all the more the press-forming properties, for example, the flanging property, of the steel sheet.

Although no particular limitation is imposed on the Si-content in the steel of the present invention, it suffices to be in the range generally accepted for aluminum-killed steels. Surface condition is improved by the addition of Si and by the reduction of the Al-content. Therefore, Si may be added in a range of less than about 0.1%. By so doing, it becomes possible to reduce the surface defects of steel sheet products and slabs of continuously cast products in which the surface condition is an important factor.

Figure 1:
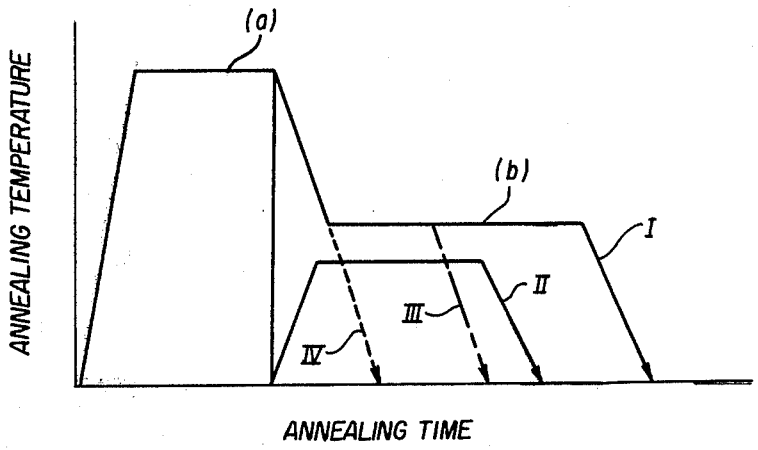
FIG. 1 is a graph showing examples of annealing cycles.

The steel of the present invention imposes no particular limitations on the melting and casting stage, hot and cold rolling stage, or annealing treatment stage after the cold rolling. For example, there is no necessity for winding up the hot-rolled steel sheet in a high temperature range in the hot rolling stage instead of in a low temperature range below about 650° C. Wind-up in a temperature range about 650° C. thickens the oxidation layer on the surface, which requires a longer time in the subsequent pickling stage and causes deterioration of the surface condition. The steel of the present invention, which allows take-up at a low temperature, is free from these problems. In addition, the annealing treatment sufficies to be a continuous annealing of low temperature and short time period by quick heating and cooling, and subsequent overaging is not necessarily required. As for the annealing cycle, it is possible to apply a heat pattern generally employed in an ordinary Sendzimir type molten zinc plating line, as indicated by curve III of FIG. 1, or a quick-cooling heat pattern by air blast as indicated by curve IV.

The properties of the steel according to the present invention are more particularly illustrated by the following example, which is provided herein for purposes of illustration only and which is not intended to be limiting unless otherwise specified.

EXAMPLE

Continuously cast slabs having the chemical compositions as shown in Table 1, which were obtained after melting and degassing treatment (RH degassing), were hot-rolled by ordinary procedures and wound up at 600° C. to obtain hot-rolled coils having a wall thickness of 2.5 mm. After washing with acid, each coil was cold-rolled into a coil of 0.8 mm in wall thickness, followed by annealing at 750° C. in a molten zinc plating line to obtain a steel sheet of end product. The mechanical properties of the steel sheet thus obtained are shown in Table 2, in which Samples 1 to 5 are of the present invention and Samples 6 and 7 are comparative materials.

TABLE 1

| | Chemical Composition (wt %) | | | | | | | | | | | |
|---|---|---|---|---|---|---|---|---|---|---|---|---|
| Sample | C | Si | Mn | N ($\times 10^{-4}$) | O ($\times 10^{-4}$) | S | sol. Al | Ti | Cr | B;REM | Ti*/C + N | Remarks |
| 1 | 0.008 | 0.01 | 0.21 | 35 | 50 | 0.008 | 0.03 | 0.023 | 0.21 | — | 0.345 | |
| 2 | 0.008 | 0.02 | 0.20 | 40 | 61 | 0.007 | 0.03 | 0.040 | 0.20 | — | 0.665 | Invention |
| 3 | 0.012 | 0.02 | 0.21 | 35 | 45 | 0.007 | 0.04 | 0.050 | 0.22 | — | 0.720 | |
| 3' | 0.012 | 0.01 | 0.17 | 35 | 48 | 0.004 | 0.04 | 0.040 | 0.15 | REM:0.04 | 0.450 | |
| 3" | 0.010 | 0.02 | 0.20 | 38 | 45 | 0.004 | 0.04 | 0.040 | 0.20 | B:0.0035 | 0.380 | |
| 4 | 0.013 | 0.02 | 0.20 | 37 | 50 | 0.004 | 0.04 | 0.050 | 0.21 | B:0.0035 REM:0.05 | 0.643 | |
| 5 | 0.007 | 0.01 | 0.20 | 35 | 52 | 0.006 | 0.04 | 0.032 | 0.36 | — | 0.595 | |
| 6 | 0.007 | 0.01 | 0.21 | 37 | 63 | 0.009 | 0.02 | — | 0.35 | — | 0 | Comparative |
| 7 | 0.007 | 0.01 | 0.20 | 35 | 54 | 0.008 | 0.03 | 0.021 | 0.01 | — | 0.315 | |

TABLE 2

| | Mechanical Properties | | | | | | | |
|---|---|---|---|---|---|---|---|---|
| Sample | Yield strength (kg/mm$^2$) | Tensile strength (kg/mm$^2$) | Elongation (%) | Work hardening index (n) | r value | Aging index (kg/mm$^2$) | Erichsen value | Remarks |
| 1 | 19.8 | 35.3 | 44 | 0.235 | 1.52 | 2.2 | 10.9 | |
| 2 | 18.5 | 35.2 | 45 | 0.240 | 1.60 | 1.5 | 11.4 | |
| 3 | 18.8 | 36.3 | 46 | 0.235 | 1.65 | 1.7 | 11.3 | Invention |
| 3' | 18.0 | 36.1 | 46 | 0.241 | 1.65 | 1.5 | 11.5 | |
| 3" | 18.3 | 36.5 | 45 | 0.238 | 1.58 | 1.7 | 11.3 | |
| 4 | 17.2 | 35.9 | 47 | 0.248 | 1.84 | 1.3 | 11.6 | |
| 5 | 17.5 | 35.1 | 46 | 0.249 | 1.67 | 1.1 | 11.8 | |
| 6 | 24.5 | 36.2 | 41 | 0.201 | 1.19 | 7.1 | 10.4 | Comparative |
| 7 | 21.7 | 35.9 | 43 | 0.210 | 1.25 | 4.9 | 10.3 | |

It is observed from Table 2 that the steel of the present invention has sufficient values of yield and tensile strengths; is excellent in various properties such as elongation, work hardening index, r value, aging index and Erichsen value; and shows good press-forming properties without any special overaging treatment.

As can be appreciated from the foregoing description, steel sheet according to the present invention has an $\bar{r}$ value of more than 1.5 and an aging index of 0.7–4.5 (kg/mm$^2$). The steel according to the invention can be processed by any kind of hot-rolling, but should preferably be cold rolled under reduction of 50–90%, heated at 30° C./sec. or more to a temperature of more than 550° C. and held at this temperature for 10 seconds to 3 minutes, and then cooled at a cooling rate of more than 20° C. Annealed steel sheet formed by this method may be overaged at 300°–500° C. for up to 3 minutes.

Having now fully described the invention, it will be apparent to one of ordinary skill in the art that many changes and modifications can be made thereto without departing from the spirit and scope of the invention as set forth herein.

What is claimed as new and desired to be secured by Letters Patent of the United States is:

1. A cold-rolled ultra low carbon steel sheet with improved press-forming properties, characterized in that said sheet contains 0.002–0.015% of C., less than 0.006% of N, less than 0.01% of O, less than 0.02% of S, 0.1–0.35% of Mn, 0.01–0.06% of acid-soluble Al, 0.02–0.15% of Ti, 0.05–0.4% of Cr, and one or both of 0.001–0.1% of a rare earth element and 0.001–0.01% of B, and has a value of less than 0.8 for the atomic ratio ($Ti^*/(C+N)$) of the total titanium content except titanium of oxide form ($Ti^*$) to the sum of carbon and nitrogen contents, with the balance Fe and incidental impurities, wherein said steel sheet has an aging index of no more than 4.5 $kg/mm^2$.

2. The steel sheet of claim 1, additionally containing Si, wherein the Si-content is less than 0.1%.

* * * * *

UNITED STATES PATENT AND TRADEMARK OFFICE

CERTIFICATE OF CORRECTION

PATENT NO. : 4,331,488

DATED : May 25, 1982

INVENTOR(S) : MASATOSHI SUDO ET AL

It is certified that error appears in the above—identified patent and that said Letters Patent is hereby corrected as shown below:

On the title page, /75/ Inventors: should read,

Masatoshi Sudo; Ichiro Tsukatani; Michiko Ishigami, all of Kobe, Japan --

Signed and Sealed this

*Tenth* Day of *August 1982*

[SEAL]

*Attest:*

GERALD J. MOSSINGHOFF

*Attesting Officer*

*Commissioner of Patents and Trademarks*